United States Patent [19]

Staerzl

[11] 4,391,254

[45] Jul. 5, 1983

[54] ATOMIZATION COMPENSATION FOR ELECTRONIC FUEL INJECTION

[75] Inventor: Richard E. Staerzl, Fond du Lac, Wis.

[73] Assignee: Brunswick Corporation, Skokie, Ill.

[21] Appl. No.: 329,993

[22] Filed: Dec. 11, 1981

[51] Int. Cl.[3] ..... F02M 51/00

[52] U.S. Cl. ..... 123/478; 123/491

[58] Field of Search ..... 123/179 L, 179 G, 491, 123/478, 492, 493

[56] References Cited

U.S. PATENT DOCUMENTS 4,132,210 1/1979 Long ..... 123/491

4,148,282 4/1979 Grassle et al. ..... 123/491

4,205,635 6/1980 Kirn et al. ..... 123/491

4,239,022 12/1980 Drews et al. ..... 123/491

*Primary Examiner*—William A. Cuchlinski, Jr.

*Attorney, Agent, or Firm*—Hopgood, Calimafde, Kalil, Blaustein & Judlowe

[57] ABSTRACT

The invention contemplates atomization compensation apparatus used in conjunction with an electronic fuel injection circuit for an internal-combustion engine. For four cycle engines, operating at low engine speed the fuel has a tendency to fall out of suspension in the intake manifold especially when the intake manifold air-temperature is low. The instant invention gradually increases the fuel flow to the engine as an inverse function of low engine speed and intake manifold air temperature to provide atomization compensation.

6 Claims, 2 Drawing Figures

ATOMIZATION COMPENSATION FOR ELECTRONIC FUEL INJECTION

BACKGROUND OF THE INVENTION

This invention relates to atomization compensation apparatus used in conjunction with an electronic fuel-injection control circuit for an internal-combustion engine of the type described in my copending U.S. patent application, Ser. No. 120,467 filed Feb. 11, 1980 now U.S. Pat. No. 4,305,351 and my U.S. Pat. No. 4,280,465 issued July 28, 1981. Reference is made to said application and to said U.S. patent for greater descriptive detail of a fuel injection engine, to which the present invention is illustratively applicable.

In fuel-injection control circuits of the character indicated, air and fuel are mixed in the engine intake manifold and this mixture is than directed to the appropriate cylinder for combustion. For four cycle engines operating at low engine speed the fuel has a tendency to fall out of suspension in the intake manifold. This problem is especially acute when the manifold air temperature is low. The tendancy for the fuel to fall out of suspension causes a decrease in atomization, a fuel lean mixture, and thus is a detriment to smooth running and efficient engine operation.

BRIEF STATEMENT OF THE INVENTION

It is a general object of the invention to provide fuel mixture correction signals for an electronic fuel-injection control circuit.

Another object of the invention is to increase the fuel flow to a four cycle internal combustion engine when the engine is operating at low speed.

A further object of the invention is to increase the fuel flow to a four cycle internal combustion engine when the engine is operating at low speed and when the intake manifold temperature is low.

A still further object of the invention is to gradually increase the fuel flow rate to an internal combustion engine as an inverse function of low engine speed and intake manifold air temperature.

Still another object is to achieve the above objects with generally uncomplicated circuitry adaptable to the fuel-mixture requirements of a variety of sizes, styles and uses of different fuel-injected internal combustion engines.

The invention achieves the foregoing objects and certain further features by utilizing an inverting linear amplifier with an input signal that is representative of engine speed. At zero engine speed the output level of the amplifier is greatest while the output level is minimum at approximately 3000 R.P.M. The output signal from the amplifier is applied to the electronic fuel injection circuit via a voltage divider network consisting of a fixed resistor in parallel with a thermistor with the thermistor functioning as a manifold air temperature sensor to provide the necessary temperature correction. Fuel flow to the associated internal combustion engine varies in direct relation to the amplitude of the amplifier output signal.

DETAILED DESCRIPTION

Figure 1:
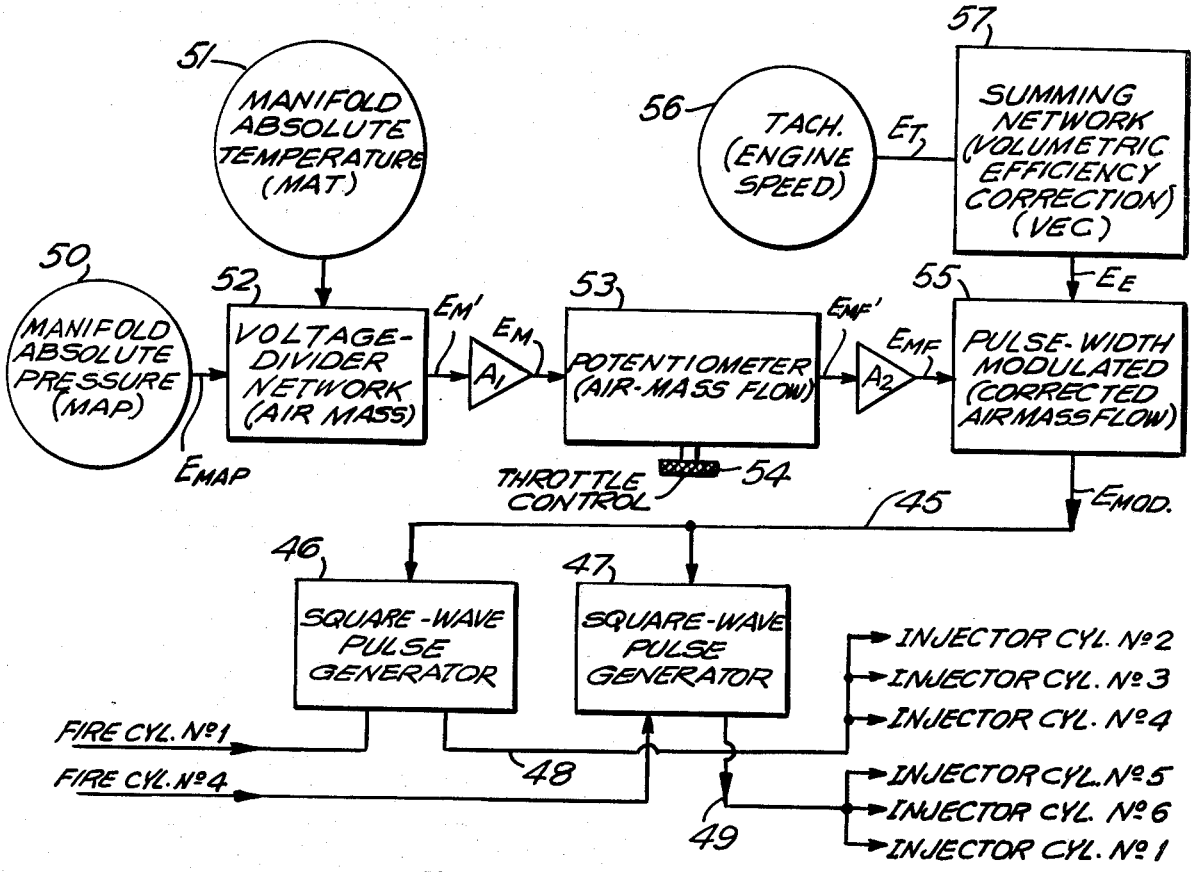
Figure 2:
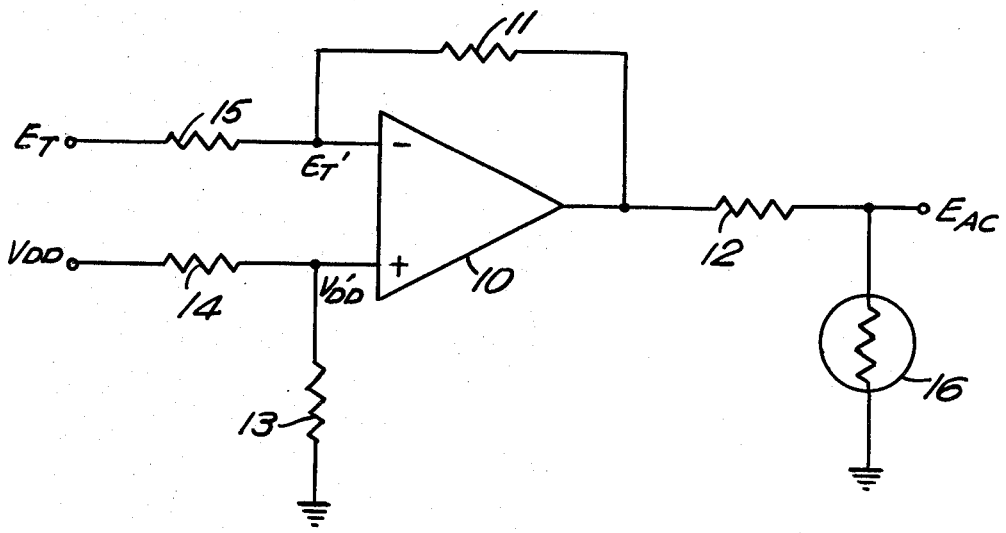

The invention will be described in detail, in conjunction with the accompanying drawings in which:

FIG. 1 is a diagram schematically showing components of an electronic fuel-injection control system for an internal combustion engine; and FIG. 2 is a diagram schematically showing the atomization compensation circuit of the instant invention.

In my issued U.S. Pat. No. 4,280,465, a fuel-injection control circuit is described in which one or more square-wave pulse generators drive solenoid-operated injectors unique to each cylinder, there being a single control system whereby the pulse generator means is modulated as necessary to accommodate throttle demands in the context of engine speed and other factors. FIG. 1 herein is adopted from said U.S. patent for purposes of simplified contextual explanation.

The control system of FIG. 1 is shown in illustrative application to a two-cycle six-cylinder 60-degree V-engine wherein injectors for cylinders #2, #3 and #4 are operated simultaneously and (via line 48) under the control of the pulse output of a first square-wave generator 46, while the remaining injectors (for cylinders #5, #6 and #1) are operated simultaneously and (via line 49) under the control of the pulse output of a second such generator 47. The base or crankshaft angle for which pulses generated at 46 are timed is determined by ignition-firing at cylinder #1, and pulses generated at 47 are similarly based upon ignition-firing at cylinder #4, i.e., at 180 crankshaft degrees from cylinder #1 firing. The actual time duration of all such generated pulses will vary in response to the amplitude of a control signal ($E_{MOD.}$), supplied in line 45 to both generators 46–47 with a greater amplitude resulting in a pulse of greater duration.

The circuit to produce the modulating-voltage $E_{MOD.}$ operates on various input parameters, in the form of analog voltages which reflect air-mass flow for the current engine speed, and a correction is made for volumetric efficiency of the particular engine. More specifically, for the circuit shown, a first electrical sensor 50 of manifold absolute pressure is a source of a first voltage $E_{MAP}$ which is linearly related to such pressure, and a second electrical sensor 51 of manifold absolute temperature may be a thermistor which is linearly related to such temperature through a resistor network 52. The voltage $E_{MAP}$ is divided by the network 52 to produce an output voltage $E_M'$, which is a linear function of instantaneous air mass or density at inlet of air to the engine. A first amplifier A1 provides a corresponding output voltage $E_M$ at the high-impedance level needed for regulation-free application to the relatively low impedance of potentiometer means 53, having a selectively variable control that is symbolized by a throttle knob 54. The voltage output $E_{MF}'$, of potentiometer means 53, reflects a "throttle"-positioned pick-off voltage and reflects instantaneous air-mass flow, for the instantaneous throttle (54) setting, and a second amplifier A2 provides a corresponding output voltage $E_{MF}$ for regulation-free application to one of the voltage-multiplier inputs of a pulse-width modulator 55, which is the source of $E_{MOD.}$ already referred to.

The other voltage-multiplier input of modulator 55 receives an input voltage $E_E$ which is a function of engine speed and volumetric efficiency. More specifically, a tachometer 56 generates a voltage $E_T$ which is linearly related to engine speed (e.g., crankshaft speed, or repetition rate of one of the spark plugs), and a summing network 57 operates upon the voltage $E_T$ and certain other factors (which may be empirically determined and which reflect volumetric efficiency of the particular engine size and design) to develop the voltage $E_E$ for the multiplier of modulator 55. It is to be understood that although the fuel injection control circuit of FIG. 1 has been illustrated in connection with a two-cycle engine, the same circuit can be used in connection with a four-cycle engine, to which the instant invention is particularly applicable.

The present invention is concerned with the nature and performance of the atomization compensation apparatus shown in FIG. 2. More particularly the apparatus illustrated in FIG. 2 is designed to interface with the electronic fuel-injection system of FIG. 1 and gradually increase the fuel flow rate to the associated internal combustion engine as an inverse function of low engine speed and intake manifold air temperature.

Amplifier 10 is an inverting linear amplifier with an input signal $E_T$ at the "−" input thereof and a bias voltage $V_{DD}$ at the "+" input thereof. Voltage $E_T$ is linearly related to engine speed, e.g. crankshaft speed of the associated internal combustion engine or the repetition rate of one of the spark plugs. Voltage $V_{DD}'$ is arranged to be greater than $E_T'$ at zero engine speed and slightly less than $E_T'$ at approximately 3000 R.P.M. Voltages $E_T$ and $V_{DD}$ are applied to amplifier 10 via resistors 14 and 15 while resistors 11 and 13 provide well known bias functions.

At zero engine speed the output of amplifier 10 is the greatest while at approximately 3000 RPM the output of amplifier 10 is minimum. The output of the amplifier is applied to a voltage divider network, consisting of resistor 12 and thermistor 16, and from there the output signal is summed (not shown) with signal $E_{MOD}$ (FIG. 1) for application to square wave pulse generators 46 and 47. Thermistor 16 functions as a manifold air temperature sensor and will decrease in resistance as manifold air temperature increases and increase in resistance as manifold air temperature decreases.

In operation therefore, at zero engine speed and minimum manifold temperature, the most critical conditions for fuel falling out of suspension in the intake manifold, the signal $E_{AC}$ will be at a maximum and will increase the amplitude of $E_{MOD}$ accordingly. This in turn increases the duration of the output pulses from generators 46 and 47, which increases fuel flow to the associated internal combustion engines and provides atomization compensation. At engine speeds of approximately 3000 R.P.M. and high manifold air temperature, the least critical conditions for fuel falling out of suspension, the signal $E_{AC}$ will be at a minimum and will decrease the amplitude of $E_{MOD}$ accordingly. This, in turn, decreases the duration of the output pulses from generators 46 and 47, which decreases fuel flow to the associated internal combustion engine; thus providing no atomization compensation. Signal $E_{AC}$ and the attendant fuel flow will of course linearly vary between the maximum and minimum positions as an inverse function of engine speed and manifold air temperature.

The described invention will be seen to meet the states objectives of providing atomization compensation at the critical conditions of zero engine speed and minimum manifold air temperature. Conversely as engine speed and manifold air temperature increase the fuel flow to the engine is gradually decreased until atomization compensation is eliminated.

While the invention has been described in detail for preferred and illustrative embodiments, it will be understood that modifications may be made without departure from the claimed scope of the invention.

What is claimed is:

1. In an electronic fuel-injection control circuit for an internal-combustion engine having an intake air manifold wherein a square-wave pulse generator provides output signals of variable duration, said output signals controlling the fuel flow rate to the internal combustion engine with an output signal of a first duration providing an increased fuel flow rate and an output signal of a second duration providing a decreased fuel flow rate, said first duration being greater than said second duration, the improvement comprising, means for sensing the air temperature within said intake air manifold, means for detecting the instantaneous speed of said internal combustion engine, means responsive to a decrease in manifold air temperature for increasing the duration of said output signals and responsive to an increase in manifold air temperature for decreasing the duration of said output signals, and means responsive to a decrease in engine speed for increasing the duration of said output signals and responsive to an increase in engine speed for decreasing the duration of said output signals, said detecting means including a linear inverting operational amplifier, a first input of said operational amplifier having applied thereto a signal linearly related to engine speed, a second input of said operational amplifier having applied thereto a predetermined bias voltage, and the output of said operational amplifier being at a maximum value when said engine speed is minimum and being at a minimum value when said engine speed reaches a predetermined value in excess of said minimum engine speed.

2. The improvement of claim 1 wherein said sensing means includes a thermistor.

3. The improvement of claim 2 wherein the output of said operational amplifier is applied to a voltage divider network, a first leg of said voltage divider network consisting of a resistor and a second leg of said voltage divider network consisting of said thermistor.

4. The improvement of claim 3 wherein said predetermined value is equal to 3000 R.P.M.

5. The improvement of claim 4 wherein said minimum engine speed is equal to zero R.P.M.

6. The improvement of claim 5 wherein said thermistor increases in resistance as said manifold air temperature decreases and said thermistor decreases in resistance as said manifold air temperature increases.

* * * * *